US010059512B2

(12) United States Patent
Adams

(10) Patent No.: US 10,059,512 B2
(45) **Date of Patent: *Aug. 28, 2018**

(54) FLOOR ASSEMBLY FOR TRANSPORTABLE REFRIGERATED CONTAINER

(71) Applicant: Fontaine Commercial Trailer, Inc., Haleyville, AL (US)

(72) Inventor: James H. Adams, Jasper, AL (US)

(73) Assignee: Fontaine Commercial Trailer, Inc., Haleyville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/587,848

(22) Filed: May 5, 2017

(65) Prior Publication Data

US 2017/0240352 A1 Aug. 24, 2017

Related U.S. Application Data

(63) Continuation of application No. 14/941,096, filed on Nov. 13, 2015, now Pat. No. 9,676,549.

(Continued)

(51) Int. Cl.

*B65D 90/02* (2006.01)
*B65D 90/12* (2006.01)

(Continued)

(52) U.S. Cl.

CPC ..... *B65D 90/02* (2013.01); *B65D 88/12* (2013.01); *B65D 88/74* (2013.01); *B65D 90/12* (2013.01)

(58) Field of Classification Search

CPC .... B62D 25/2054; B62D 25/20; B62D 33/04; B62D 33/046; B62D 33/044;

(Continued)

(56) References Cited

U.S. PATENT DOCUMENTS 1,789,827 A 1/1931 McKay
1,939,732 A 12/1933 Richard (Continued)

FOREIGN PATENT DOCUMENTS

DE 19946053 4/2001
DE 102005040419 3/2007

(Continued)

*Primary Examiner* — Theodore V Adamos
(74) *Attorney, Agent, or Firm* — Andrus Intellectual Property Law, LLP

(57) ABSTRACT

A floor assembly for a trailer includes stringers that extend in a transverse direction of the assembly and are spaced from one another in a longitudinal direction of the assembly. The stringers are made of a thermally insulative first material. A bottom flange is coupled to a lower portion of a respective stringer. A top flange made of a second material is coupled to an upper portion of a respective stringer. Floor panels are also provided. Each floor panel extends in the longitudinal direction, is supported by the top flange, is coupled to another floor panel along respective edges thereof, and has at least one rib that extends in the longitudinal direction and depends substantially perpendicularly from a bottom surface thereof. Each floor panel is made of the second material and each at least one rib is welded to a top surface of the top flange.

18 Claims, 9 Drawing Sheets

Related U.S. Application Data

(60) Provisional application No. 62/086,265, filed on Dec. 2, 2014.

(51) Int. Cl.
*B65D 88/12* (2006.01)
*B65D 88/74* (2006.01)

(58) Field of Classification Search
CPC .... B62D 29/008; B62D 29/001; B62D 33/02; B62D 21/02; B62D 21/03; B65D 90/02; B65D 90/12; B65D 88/12; B65D 88/74; B65D 88/744; E04B 5/10; E04B 5/12; E04B 5/48; E04B 5/43; B61D 17/10; B61D 17/00; B61D 17/04
USPC ..... 52/483.1, 764, 770, 781.3, 272, 588.1, 52/177; 296/181.1, 181.2, 181.3, 181.6, 296/182.1, 184.1, 187.08, 193.07, 24.35; 105/422, 375, 396, 413, 414, 418, 419; 220/1.5
See application file for complete search history.

(56) References Cited

U.S. PATENT DOCUMENTS

| | | | | |
|---|---|---|---|---|
| 2,147,130 | A | 2/1939 | Sisson | |
| 2,162,361 | A | 6/1939 | Sisson | |
| 2,554,657 | A | 5/1951 | Betterton et al. | |
| 3,196,499 | A | 7/1965 | Houvener | |
| 3,224,500 | A | 12/1965 | Walter | |
| 4,091,743 | A | 5/1978 | Lemon | |
| 4,186,537 | A | 2/1980 | Mountz | |
| 4,329,827 | A | 5/1982 | Thorn | |
| 4,407,878 | A | 10/1983 | Smith et al. | |
| 4,758,128 | A | 7/1988 | Law | |
| 4,966,082 | A * | 10/1990 | Takeichi | B62D 25/2054 105/422 |
| 5,054,843 | A | 10/1991 | Gray | |
| 5,058,352 | A | 10/1991 | Loiselle et al. | |
| 5,143,416 | A | 9/1992 | Karapetian | |
| 5,199,632 | A * | 4/1993 | Takeichi | B61D 17/04 228/181 |
| 5,351,990 | A | 10/1994 | Thomas | |
| 6,082,810 | A | 7/2000 | Bennett | |
| 6,505,449 | B1 | 1/2003 | Gregori | |
| 6,505,883 | B1 | 1/2003 | Ehrlich | |
| 6,722,287 | B2 | 4/2004 | Norton et al. | |
| 6,848,233 | B1 | 2/2005 | Haszler et al. | |
| 7,823,362 | B2 | 11/2010 | Meyer | |
| 7,829,165 | B2 | 11/2010 | Grandominico et al. | |
| 7,861,970 | B2 | 1/2011 | Griess et al. | |
| 7,963,410 | B2 | 6/2011 | Joergenses et al. | |
| 2001/0010855 | A1* | 8/2001 | Aota | B23K 20/122 428/98 |
| 2006/0071506 | A1 | 4/2006 | Adams | |
| 2006/0115320 | A1 | 6/2006 | Wood et al. | |
| 2007/0277453 | A1* | 12/2007 | Trageser | E01C 9/083 52/177 |
| 2007/0289478 | A1* | 12/2007 | Becker | B61D 17/08 105/404 |
| 2009/0200423 | A1 | 8/2009 | Tucker | |
| 2012/0169087 | A1* | 7/2012 | Griffin | B62D 25/2054 296/184.1 |
| 2015/0307145 | A1 | 10/2015 | Weissmann | |

FOREIGN PATENT DOCUMENTS

| | | |
|---|---|---|
| DE | 102006009857 | 10/2007 |
| DE | 202006010594 | 12/2007 |
| DE | 102013103339 | 10/2014 |
| EP | 2116447 | 11/2009 |
| EP | 2116454 | 11/2009 |
| EP | 2116461 | 11/2009 |
| EP | 2123543 | 11/2009 |
| EP | 2392453 | 12/2011 |
| EP | 2116453 | 7/2013 |
| EP | 2116455 | 7/2013 |
| EP | 2116459 | 7/2013 |
| EP | 2116456 | 8/2013 |
| EP | 2981449 | 2/2016 |
| EP | 2123542 | 3/2016 |
| WO | 2016091280 | 6/2016 |

* cited by examiner

FLOOR ASSEMBLY FOR TRANSPORTABLE REFRIGERATED CONTAINER

CROSS-REFERENCE TO RELATED APPLICATION

The present application is a continuation of U.S. application Ser. No. 14/941,096, filed Nov. 13, 2015, which claims the benefit of U.S. Provisional Application Ser. No. 62/086,265, filed Dec. 2, 2014, both of which are hereby incorporated by reference herein.

FIELD

The present disclosure relates to refrigerated containers, such as those used as trailers or truck bodies.

BACKGROUND

U.S. Pat. No. 3,224,500 discloses a floor panel which is reinforced on its under side by a plurality of laterally spaced metallic longitudinal ribs. The floor panel is preferably made from extruded members so that the ribs are integrally formed with the top sheet. The floor panel rests upon a plurality of elongated transverse support elements. These transversely extending support elements are spaced apart longitudinally of the vehicle. The transversely extending members are in turn supported by a plurality of longitudinal stringers extending longitudinally of the vehicle body and spaced apart transversely of the body. Stringers rest upon and are supported by metallic cross beams which in turn transmit the entire weight of the cargo to the trailer longitudinal frame.

U.S. Pat. No. 4,091,743 discloses a plurality of modular units formed of ducts and horizontal load-supporting webs each forming part of a ventilating floor structure with the ducts and webs being interconnected to adjacent modular units for forming a total floor. The ducts have upwardly diverging sidewalls for strength and a duct of one modular unit is provided with a bead that forms half of a joint to be slid within a downwardly opening recess forming the other half of the joint on an adjacent web. The recess is provided with a downwardly and laterally curving guide flange so that the bead can be rolled into the recess as the modular unit having the bead is rotated into position. The interconnected ducts and webs are underlayed with foam insulation which is carried up into each web for additional insulating thickness the joint is essentially waterproof from water passing into or through the ducts.

U.S. Pat. No. 6,082,810 discloses a cargo floor construction and method of constructing same that includes a multiplicity of mounting clips that are secured to the cargo vehicle support members in laterally spaced and longitudinally aligned rows. The mounting clips are provided with a shape for mating and interlocking with the lateral edges of longitudinally extending floor planks that preferably are extruded with the mating edge shapes. Fasteners are used to secure the mounting clips to the vehicle support members but those fasteners do not pierce the floor planks. In some embodiments of the interlocking mounting clips and floor plank edges, the floor plank is elastically deformed to engage or snap onto the mounting clip to prevent lateral movement of the floor plank in either direction.

U.S. Pat. No. 7,963,410 discloses a container floor plate, in particular for a refrigerated container, with an upper floor layer, a lower floor layer and an intermediate insulating layer, support blocks being located between the upper floor layer and the lower floor layer. The purpose of the invention is to obtain a good insulation with a small mass. For this purpose, the lower floor layer is provided with several transversal supports, each support block being supported on a transversal support.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example of the present disclosure, a floor assembly for a transportable refrigerated container is defined along a transverse direction and a longitudinal direction perpendicular to the transverse direction. The floor assembly includes a plurality of transverse stringers spaced from one another in the longitudinal direction of the floor assembly. The assembly also includes a plurality of transverse bottom flanges, each transverse bottom flange in the plurality of transverse bottom flanges being coupled to a lower portion of a respective transverse stringer in the plurality of transverse stringers and being coupled to a neighboring transverse bottom flange along respective transversely extending side edges thereof. A top flange comprising a supporting sheet is coupled to an upper portion of each transverse stringer in the plurality of transverse stringers. A plurality of longitudinal panels are supported by the supporting sheet and coupled to one another along respective longitudinally extending edges thereof to form a floor surface, each longitudinal panel in the plurality of longitudinal panels having at least one longitudinally extending rib depending substantially perpendicularly from a bottom surface thereof, the at least one rib being coupled to a top surface of the supporting sheet.

In another example of the present disclosure, a floor assembly for a transportable refrigerated container is defined along a transverse direction and a longitudinal direction perpendicular to the transverse direction. A plurality of transverse stringers are spaced from one another in the longitudinal direction of the floor assembly. The floor assembly also includes a plurality of transverse bottom flanges, each transverse bottom flange in the plurality of transverse bottom flanges being coupled to a lower portion of a respective transverse stringer in the plurality of transverse stringers and being welded to a neighboring transverse bottom flange along respective transversely extending side edges thereof. A top flange comprising a supporting sheet is coupled to an upper portion of each transverse stringer in the plurality of transverse stringers. A plurality of longitudinal panels are supported by the supporting sheet and welded to one another along respective longitudinally extending edges thereof to form a floor surface, each longitudinal panel in the plurality of longitudinal panels having a plurality of longitudinally extending ribs depending substantially perpendicularly from a bottom surface thereof, wherein a lower end of each rib in the plurality of longitudinally extending ribs is welded to a top surface of the supporting sheet.

In another example of the present disclosure, a floor assembly for a trailer is defined along a transverse direction and a longitudinal direction perpendicular to the transverse direction. The floor assembly includes a plurality of stringers that extend in the transverse direction of the floor assembly and are spaced from one another in the longitudinal direction of the floor assembly. The plurality of stringers are made of a thermally insulative first material. A bottom flange is coupled to a lower portion of a respective stringer in the plurality of stringers. A top flange made of a second material is coupled to an upper portion of a respective stringer in the plurality of stringers. A plurality of floor panels are provided, wherein each floor panel in the plurality of floor panels extends in the longitudinal direction, is supported by the top flange, is coupled to another floor panel along respective edges thereof that extend in the longitudinal direction, and has at least one rib that extends in the longitudinal direction and depends substantially perpendicularly from a bottom surface of the floor panel. Each floor panel is made of the second material and each at least one rib is welded to a top surface of the top flange.

According to another example of the present disclosure a floor assembly for a trailer is defined along a transverse direction and a longitudinal direction perpendicular to the transverse direction. A plurality of stringers made of a first material extend in the transverse direction of the floor assembly and are spaced from one another in the longitudinal direction of the floor assembly. A bottom flange is coupled to a lower portion of a respective stringer in the plurality of stringers. A bottom cap is associated with each respective stringer. The bottom cap extends in the transverse direction and comprises a lower channel for seating the lower portion of the respective stringer therein. The bottom cap projects from an upper surface of the bottom flange. A top flange is coupled to an upper portion of a respective stringer in the plurality of stringers, and the top flange is made of a second material that is different than the first material. A top cap is associated with each respective stringer and extends in the transverse direction and comprises an upper channel for locating the upper portion of the respective stringer therein. The top cap is one of integral with and coupled to a bottom surface of the top flange. A plurality of floor panels are provided, wherein each floor panel in the plurality of floor panels extends in the longitudinal direction, is supported by and welded to a top surface of the top flange, and is coupled to another floor panel along respective edges thereof that extend in the longitudinal direction to form a floor surface. The bottom cap and the top cap are provided as a guide for each respective stringer such that the respective stringer remains in place within the lower and upper channels and perpendicularly upright between the bottom and top flanges.

DETAILED DESCRIPTION

Figure 1:
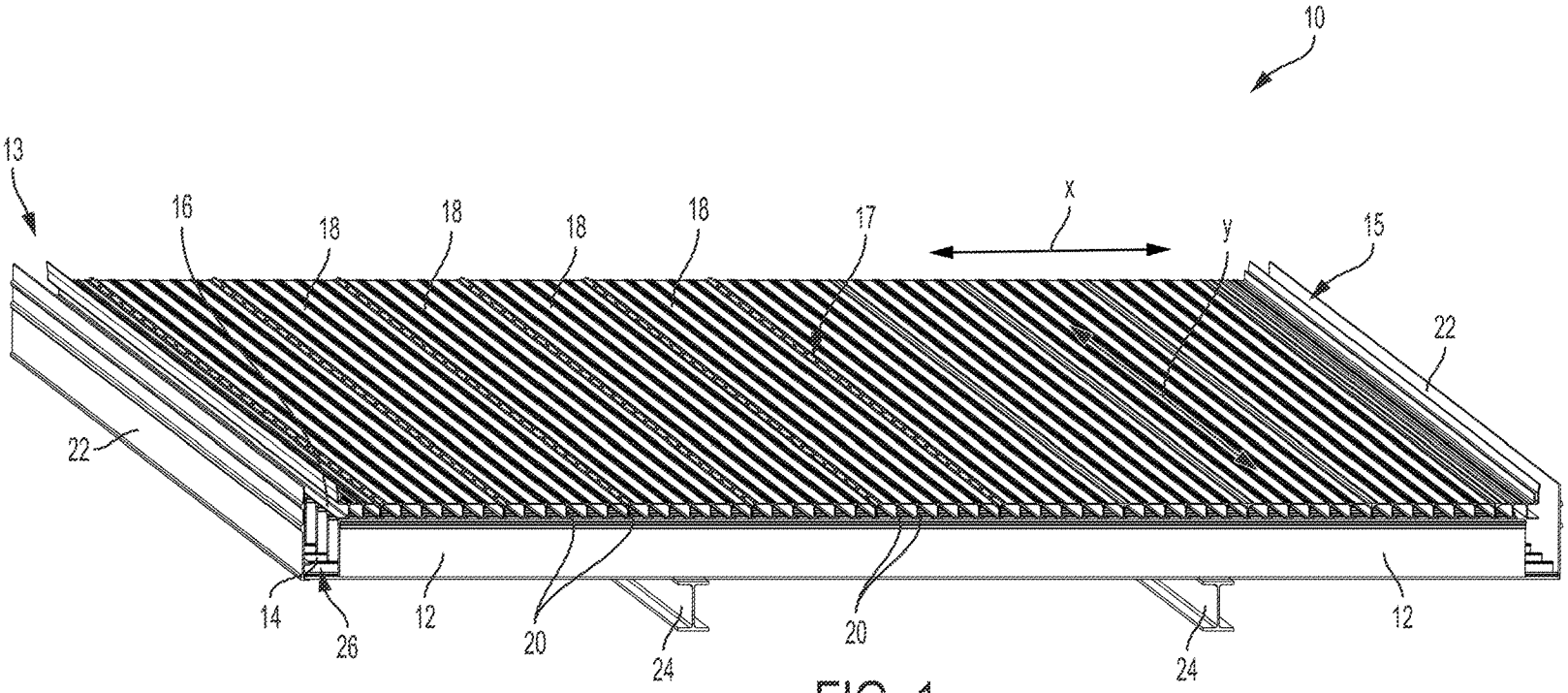
FIG. 1 illustrates a perspective end view of a floor assembly according to the present disclosure.

The present disclosure relates to a refrigerated container that has minimized weight, a lower center of gravity, and increased thermally efficiency in comparison to prior art containers. The present design eliminates the need for steel or aluminum cross members that are usually mounted underneath current refrigerated floors to provide load support. In the present disclosure, the addition of unique top and bottom flanges 19, 14 to a thermal spacer material (transverse stringer 12) transforms the thermal spacer material into a structural member that replaces the steel I-beam cross members used in current systems for load support.

Further, the unique design of the herein-described transverse bottom flanges 14 allows connection thereof to an outer longitudinal side rail 22 (intended for connection to a wall panel of the container) by welding. This welded connection, and the fact that the present floor assembly 10 is held together by welding wherever possible, means that the present design also has improved thermal characteristics, as it eliminates thermal shorts from mechanical fasteners that are currently used in prior art systems. These and other advantages will be described with respect to the embodiment discussed below.

A shown in FIG. 1, the present disclosure is of a floor assembly 10 for a transportable refrigerated container. The container in which the floor assembly 10 is included can be, for example, an intermodal container, a truck body, a trailer, a railroad car box, or any other type of cargo container. The floor assembly 10 is defined along a transverse direction x and a longitudinal direction y perpendicular to the transverse direction x. The floor assembly 10 comprises a plurality of transverse stringers 12 (extending in transverse direction x) spaced from one another in the longitudinal direction y of the floor assembly 10. (See also FIG. 2.) Each transverse stringer 12 has approximately the same length and extends from a location proximate a first side 13 to a location proximate a second side 15 of the floor assembly 10. However, the transverse stringers 12 do not extend all the way to the end of each side 13, 15 of the floor assembly 10, for reasons that will be described further herein below. The sides 13, 15 of the floor assembly 10 are where laterally-spaced, upwardly-extending side walls of the container would be placed. Each transverse stringer 12 is spaced an approximately equal distance from its neighboring transverse stringer 12, such that uniform loads placed on top of the transverse stringers 12 are distributed generally equally across each of the transverse stringers 12.

As will also be described further herein below, the transverse stringers 12 act as a thermal spacer material, and prevent heat transfer from materials below the transverse stringers 12 to materials resting on top of the transverse stringers 12, which latter materials are in contact with refrigerated air that keeps the container's cargo cool. In one example, the transverse stringers 12 are made of wood, such as for example pressure treated oak hardwood. In another example, the transverse stringers 12 are thermoplastic beam extrusions. Any material that can be cut or formed into a beam and that does not conduct heat (or does not conduct heat well), and therefore is thermally insulative, can be used to make the transverse stringers 12. Generally, in order to keep manufacturing of the transverse stringers and the parts with which they connect relatively simple, each transverse stringer 12 has the same size and shape. For example, referring to FIG. 5, each transverse stringer 12 can have a rectangular cross-sectional shape with a height of the transverse stringer 12 being approximately three times its width.

Figure 2:
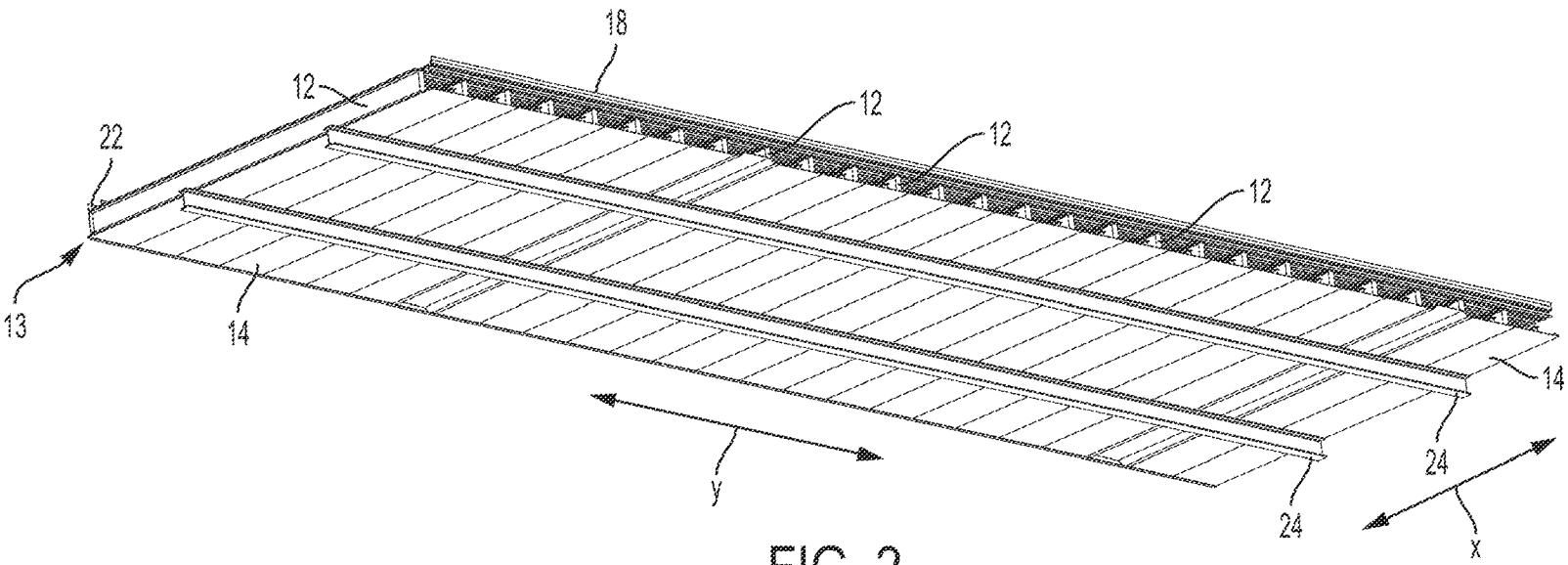
FIG. 2 illustrates a perspective underside view of the floor assembly of FIG. 1.
Figure 5:
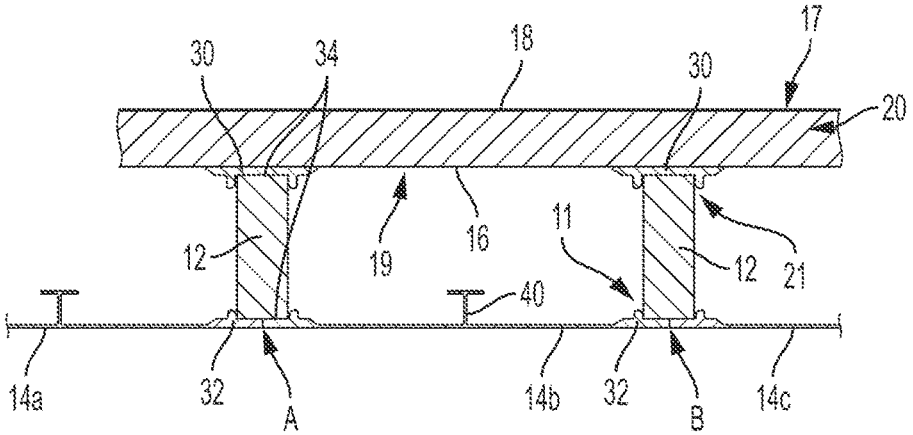
FIG. 5 illustrates a detailed view of a cross section of the floor assembly along the line 5-5 in FIG. 4.
Figure 9:
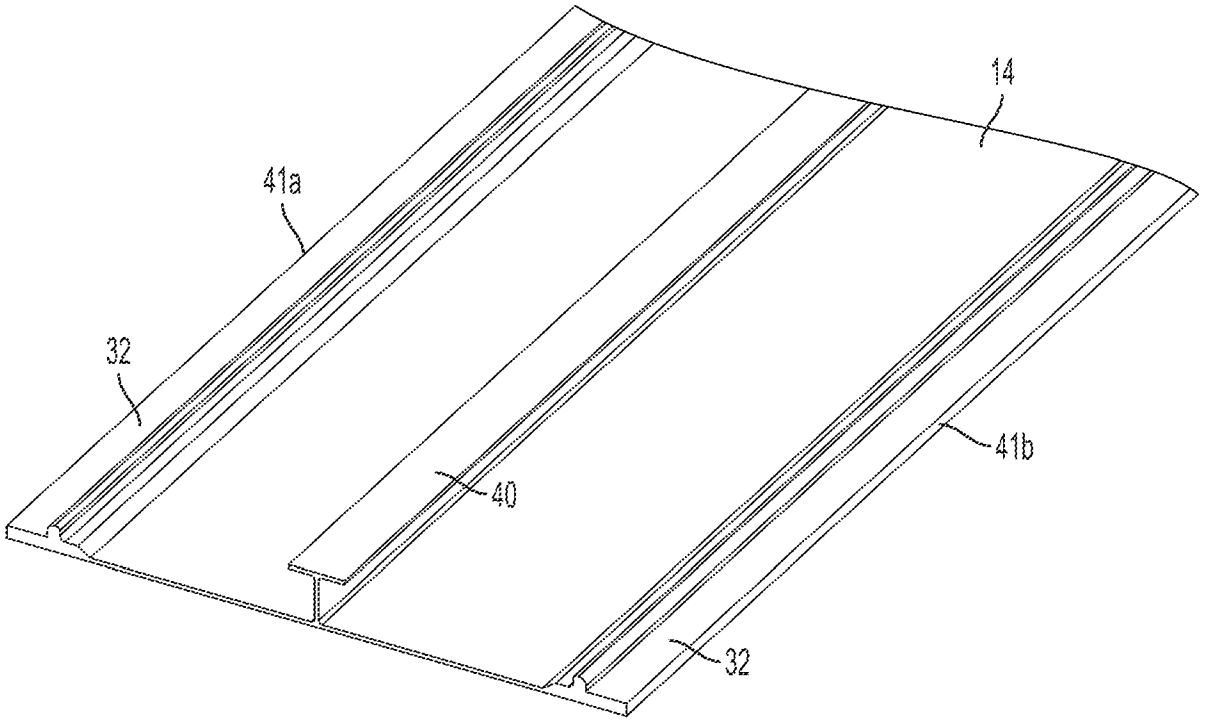
FIG. 9 shows a transverse bottom flange piece separated from the floor assembly.

Referring now to FIGS. 2 and 5, a plurality of transverse bottom flanges 14 are also provided in the floor assembly 10. Each transverse bottom flange 14 in the plurality of transverse bottom flanges is coupled to a lower portion 11 of a respective transverse stringer 12 in the plurality of transverse stringers. Each transverse bottom flange 14 is also coupled to a neighboring transverse bottom flange 14 along respective transversely extending side edges thereof. See transverse lines in FIG. 2 and 41*a*, 41*b* in FIG. 9. For example, referring to FIG. 5, the leftmost transverse bottom flange 14*a* (only a portion of which is shown) is connected along its right transversely extending side edge to a left transversely extending side edge of middle transverse bottom flange 14*b* at point A. Similarly, the right transversely extending side edge of middle transverse bottom flange 14*b* is connected to the left transversely extending side edge of rightmost transverse bottom flange 14*c* at point B. In one example, each flange side edge is welded to its neighboring flange side edge, such as shown at locations A and B. As shown herein, each flange side edge abuts the neighboring flange side edge to which it is welded beneath a respective transverse stringer 12 in the plurality of transverse stringers. This provides a supported location for the weld (see points A, B) to be made, as the transverse stringers 12 are also adhered to the transverse bottom flanges 14 at this location, as will be described further herein below. A transverse bottom flange piece 14 and its transversely extending side edges 41*a*, 41*b* are shown separately in FIG. 9.

FIGS. 1-4 show I-beams 24 that are used to support the floor assembly 10 where it is connected to a truck or other vehicle. The I-beams 24 extend in the longitudinal direction y and are coupled to a bottom surface of each of the transverse bottom flanges 14, such as by welding. The I-beams 24 thus extend across a plurality of the transverse bottom flanges 14.

Figure 10:
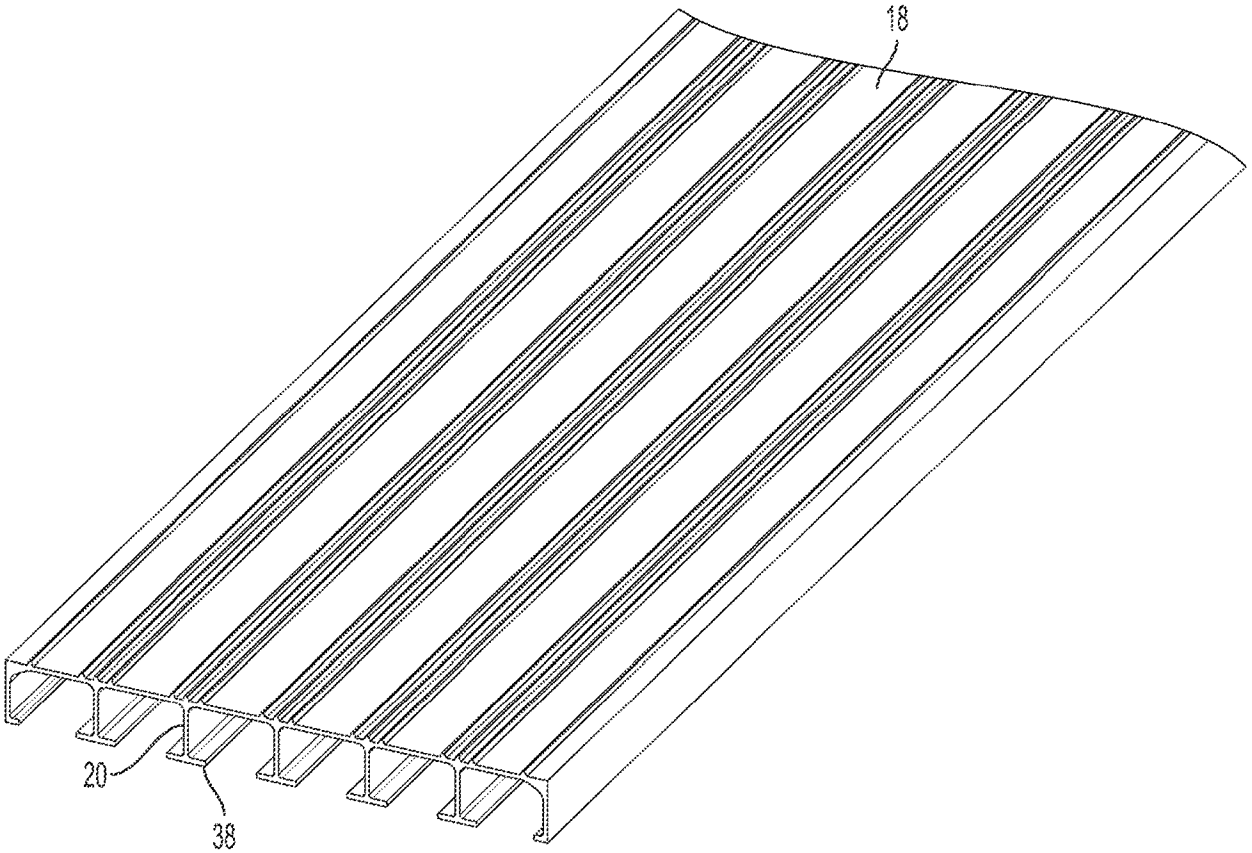
FIG. 10 shows a longitudinal panel piece separated from the floor assembly.
Figure 11:
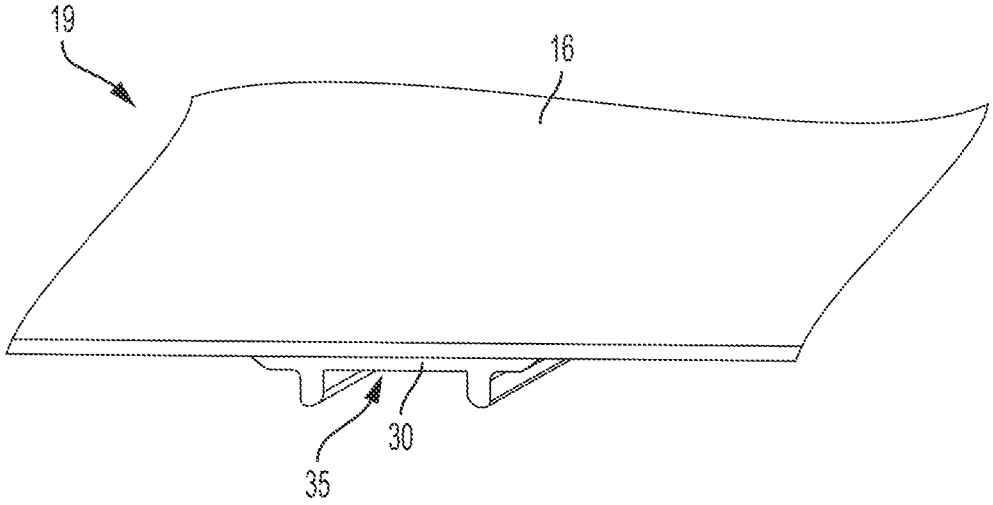
FIG. 11 shows a portion of the top flange separated from the floor assembly.

Referring to FIGS. 5-8, a top flange 19 is coupled to an upper portion 21 of each transverse stringer 12 in the plurality of transverse stringers. The top flange 19 comprises a supporting sheet 16. The supporting sheet 16 can be one single sheet of material (see FIG. 11), or if necessary can be several large sheets of material. In one example, the supporting sheet 16 is a single piece of aluminum sheet (plate), which is lightweight yet provides the necessary strength to support other components of the floor assembly 10. Such components include a plurality of longitudinal floor panels 18 (shown separated by dashed lines in FIG. 1) that are supported by the supporting sheet 16 and coupled to one another along respective longitudinally extending edges thereof to form a floor surface 17. In one example, the plurality of longitudinal floor panels 18 are friction stir welded to one another along the edges thereof to form the floor surface 17. Each longitudinal floor panel 18 in the plurality of longitudinal floor panels has at least one longitudinally extending rib 20 (and here, a plurality of longitudinally extending ribs 20) depending substantially perpendicularly from a bottom surface 36 thereof. (See also FIG. 10.) The ribs 20 are coupled to a top surface of the supporting sheet 16 (top flange 19).

Figure 4:
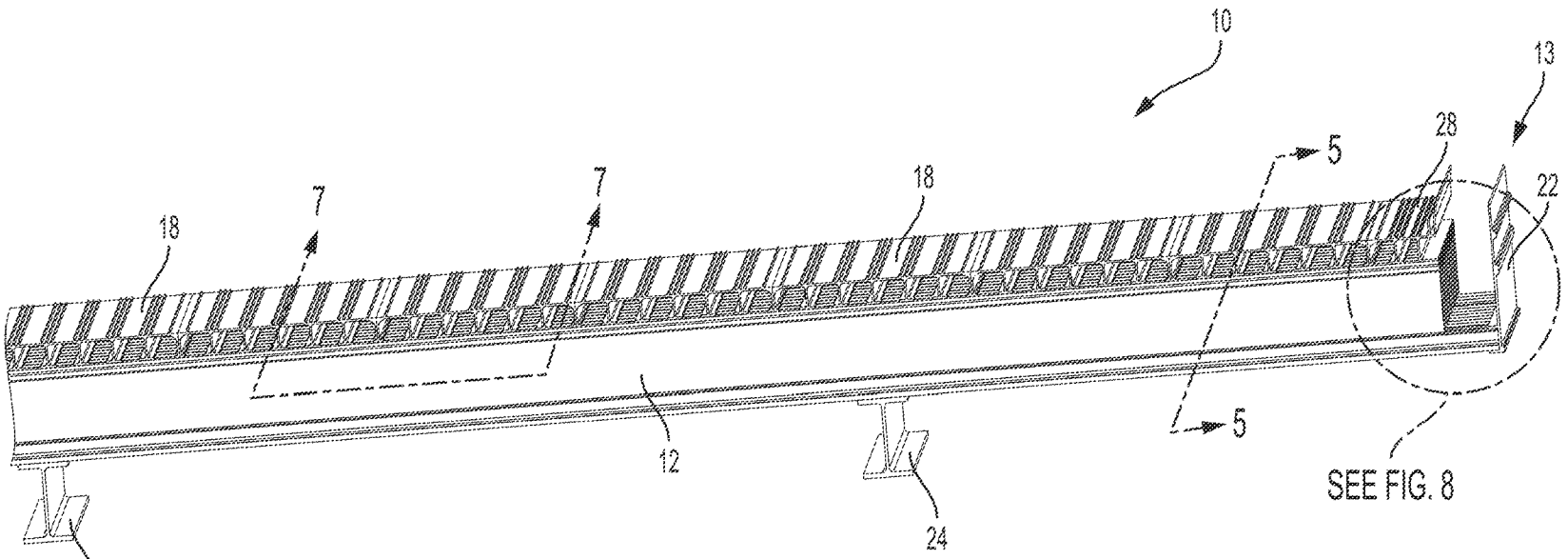
FIG. 4 illustrates a more zoomed out view of the side of FIG. 3.
Figure 7:
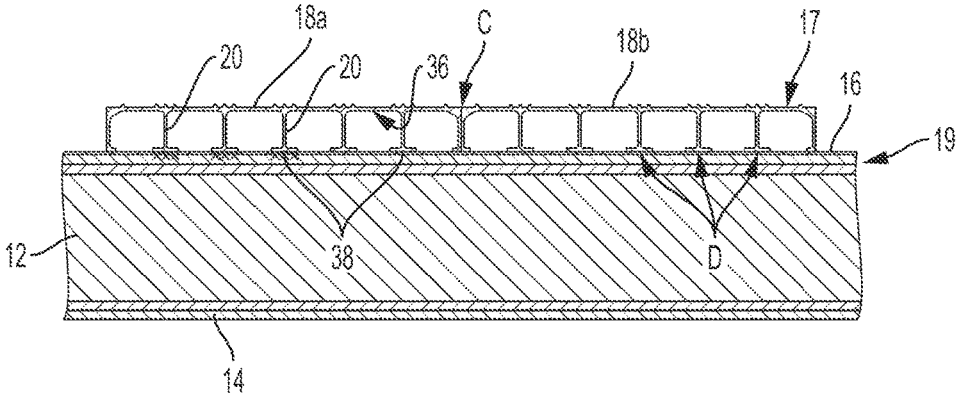
FIG. 7 illustrates a cross sectional view along the ling 7-7 in FIG. 4.

FIG. 7 shows a cross sectional view through the lines 7-7 of FIG. 4. Shown herein are a side view of a transverse stringer 12, a transverse bottom flange 14, and two neighboring longitudinal floor panels 18*a* and 18*b*. Individual longitudinal floor panels 18*a*, 18*b* can be joined to one another at the location C where indicated. As mentioned herein above, the joints at location C can be welds, which extend the entire longitudinal length of the floor assembly 10. The welds are preferably friction stir welds, but could also be MIG welds. Additionally, the plurality of longitudinally extending ribs 20 that depend substantially perpendicularly from the bottom surface 36 of the longitudinal floor panels 18 are shown. As shown in both FIGS. 7 and 8, a lower end of each rib 20 in the plurality of longitudinally extending ribs comprises a projection 38 that is parallel to the top surface of the supporting sheet 16 (top flange 19) and is welded thereto. For example, each of these ribs 20 ends in a T-shaped projection 38, which is welded to the top surface of the supporting sheet 16 (top flange 19). These welds are shown at locations D and could be MIG welds or spot friction stir welds.

Figure 6:
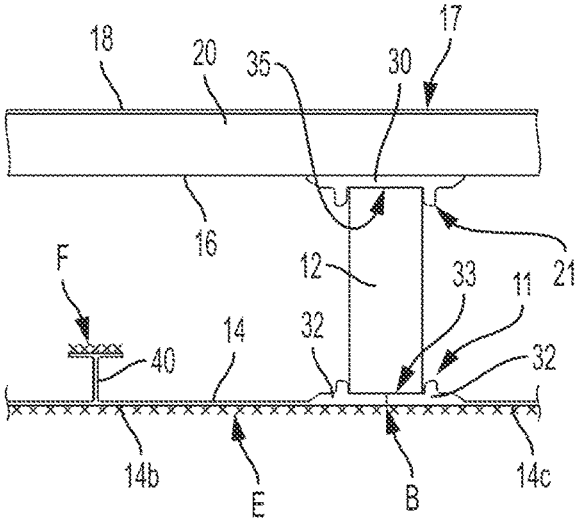
FIG. 6 illustrates a detailed view of the cross section shown in FIG. 5.
Figure 8:
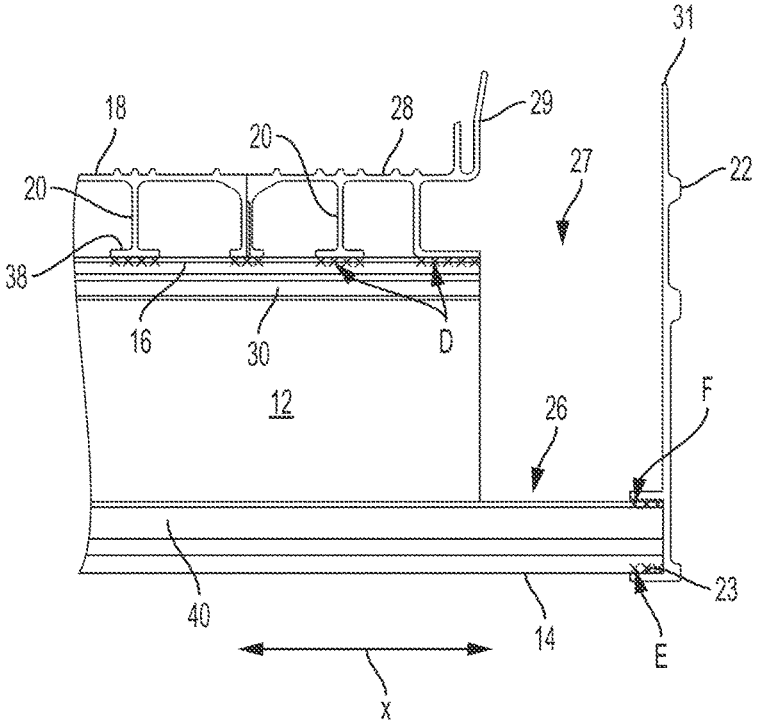
FIG. 8 illustrates a detailed view of the area circled in FIG. 4.

As can be seen best in FIGS. 1, 3-4, and 8, laterally opposite ends of each transverse bottom flange 14 extend in the transverse direction x beyond opposite ends of each respective transverse stringer 12 and beyond the sides of the outermost longitudinal floor panels 18. This creates a ledge 26 at either side 13, 15 of the floor assembly 10. In one example, the floor assembly 10 further comprises first and second longitudinal side rails 22 coupled to the opposite ends of each transverse bottom flange 14. For example, a longitudinal lip 23 may be provided on each of the longitudinal side rails 22 that extends under the ends of the transverse bottom flanges 14. The lip 23 may be welded, such as by MIG welding, to a lower surface of the transverse bottom flanges 14 along the entire bottom width of the transverse bottom flanges 14 as shown at spots E in FIGS. 6 and 8. As shown in FIGS. 5, 6, and 8, a transverse extrusion 40 may be provided that projects upwardly from an upper surface of each transverse bottom flange 14. In the example shown, the transverse extrusion 40 is a T-shaped extrusion, where the bottom of the T is integral with the remainder of the transverse bottom flange 14. The transverse extrusion 40 has opposite ends on either side 13, 15 of the floor assembly 10 that are welded to a respective one of the opposite longitudinal side rails 22. For example, MIG welds can also be made along the top of T-shaped transverse extrusions 40 such as shown at spots F. The transverse extrusions 40 ensure proper positioning of the longitudinal side rail 22 with respect to the transverse bottom flanges 14, as well as provide extra areas for reinforcing welds.

The longitudinal side rails 22 extend perpendicularly with respect to each transverse bottom flange 14 and perpendicularly to the ledge 26. The ledges 26 are therefore bounded on either lateral side by the opposite ends of the transverse stringers 12 and the opposite longitudinal side rails 22. Each ledge 26 has an open channel 27 above it, defined between the ends of the transverse stringers 12 and the inner surface of the longitudinal side rail 22, into which a side wall of the container can be inserted. The side wall would rest on the ledge 26 and would be coupled to the longitudinal side rail 22 in any manner known to those having ordinary skill in the art.

Figure 3:
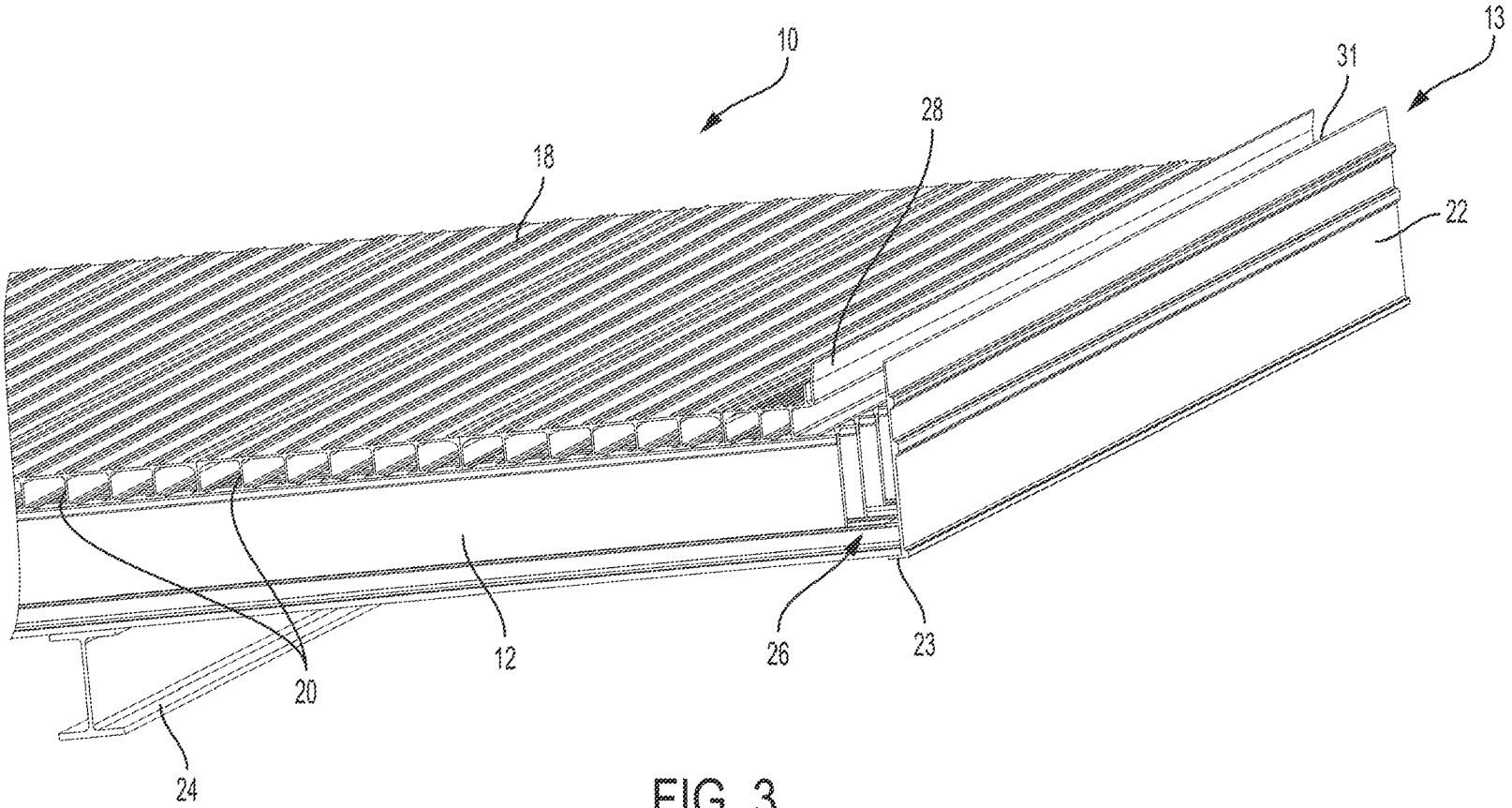
FIG. 3 illustrates a close up view of one side of the floor assembly.

FIGS. 3, 4, and 8 also show a floor-to-wall connecting panel 28 located at the side of the assembly 10 and connected to one of the longitudinal floor panels 18. The floor-to-wall connecting panel 28 is shaped differently from the longitudinal floor panels 18 because it is where the side wall of the refrigerated container would be coupled to the floor assembly 10, as shown at channel 27 in FIG. 8. As mentioned above, a lower portion of the wall panel would fit into the channel 27 formed above the ledge 26 and rest thereupon, and the side wall panel, longitudinal side rail 22, and floor-to-wall connecting panel 28 could be welded together. For example, the floor-to-wall connecting panel 28 could be welded to the side wall panel along an upper edge of an upwardly protruding arm 29 thereof. The side wall panel could also be welded to the longitudinal side rail 22 along its upper edge 31. The longitudinal side rail 22 therefore provides an airtight connection between the floor assembly 10 and a wall assembly (not shown) of the refrigerated container. Although only one longitudinal side rail 22 at side 13 is shown and described herein, it should be understood that a mirror image longitudinal side rail is provided at the opposite side 15 of the floor assembly 10.

Turning now to FIG. 5, which shows a cross sectional view along the lines 5-5 of FIG. 4, and to FIG. 6, a more detailed discussion of the cross section of the floor assembly 10 will be described. The transverse stringers 12 are shown in cross section here. The transverse stringers 12 are provided with top caps 30 and bottom caps 32, which caps 30, 32 extend the length of the transverse stringers 12. Thus, the floor assembly 10 includes a plurality of bottom caps 32, each bottom 32 cap in the plurality of bottom caps being formed where each flange side edge abuts its neighboring flange side edge (see points A and B). As shown, the bottom caps 32 provided on each transverse stringer 12 cover only one half of the width of the transverse stringer 12 to which they are adhered. Still referring to FIG. 5, one transverse bottom flange 14 begins at point A and ends at point B, and therefore comprises two separate halves of two separate bottom caps 32. This entire transverse bottom flange 14 from point A to point B comprises one extrusion, thereby providing easy manufacturing of the plurality of transverse bottom flanges 14. The transverse bottom flanges 14 are welded together along neighboring edges at the noted points A and B, for example by friction stir welding or MIG welding. Each bottom cap 32 comprises a lower channel 33 (see FIG. 8) for seating the lower portion 11 of a respective transverse stringer 12 therein. As shown in FIGS. 5 and 6, each bottom cap 32 and respective lower channel 33 are formed partly by a first transverse bottom flange (e.g. 14*b*) and partly by a neighboring second transverse bottom flange (e.g. 14*c*). The transverse bottom flanges 14 include oppositely upwardly projecting surfaces that slope up toward the top of the channel 33 and then step down to the channel half formed by that transverse bottom flange 14. The upwardly sloping portions of the bottom cap 32 provide strength to the channel 33, as it holds the transverse stringer 12. The steps, which are oriented perpendicular to the majority of the transverse bottom flange 14, provide a tight fit against the rectangular shape of the transverse stringer 12.

The top flange 19 comprises the plurality of top caps 30. Each top cap 30 in the plurality of top caps comprises an upper channel 35 for locating the upper portion 21 of a respective transverse stringer 12 therein. In the example shown, each top cap 30 is formed integrally with the supporting sheet 16 (top flange 19), such as by extruding the aluminum of the sheet. In other examples, the top caps 30 are welded or otherwise adhered to the supporting sheet 16. The top caps 30 are mirror images of the bottom caps 32, except each top cap 30 is preferably a single piece integral with or connected to the supporting sheet 16, rather than two combined halves. Thus, each top cap 30 includes two oppositely downwardly sloping portions and two reverse steps that lead to the upwardly-recessed channel 35, which is sized to fit the transverse stringer 12 therein. See also FIG. 11.

The top and bottom caps 30, 32 are provided as guides for the transverse stringers 12 such that they remain in place between the supporting sheet 16 and the plurality of transverse bottom flanges 14 by being located in the channels 33, 35. The caps 30, 32 may be adhered to the transverse stringers 12 at adhesive joints 34. Each cap 30, 32 and channel 33, 35 is located one above the other so that the transverse stringers 12 can be held upright perpendicular to the supporting sheet 16 and the transverse bottom flanges 14. Thus, the transverse stringers 12 thermally isolate the supporting sheet 16 (which, as noted above, can be made of aluminum) and the longitudinal floor panels 18 thereupon (which can also be made of aluminum) from the transverse bottom flanges 14. Refrigerated air can be provided between the ribs 20 of the longitudinal floor panels 18, thereby cooling the longitudinal floor panels 18 and the cargo in the container, with such refrigerated air being thermally isolated from the outside temperatures of the transverse bottom flanges 14.

If the longitudinal floor panels 18 that form the upper floor surface 17 are friction stir welded to one another as shown at dashed lines in FIG. 1 (see also location C in FIG. 7), as opposed to snapping them together and MIG welding them as in the prior art, this will provide increased floor strength at a lighter weight, improved thermal efficiencies, and an increased weight capacity. Further, friction stir welding the aluminum longitudinal floor panels 18 is not prone to defects associated with MIG welding, which defects contribute to water vapor intrusion into the insulation within the floor assembly 10. Additionally, by welding the flooring across the top flange's supporting sheet 16 as shown at spots D in FIGS. 7 and 8, the longitudinal floor panels 18 making up the floor are supported better and will not deform as easily as when only fastened on each edge as the current state of the art provides. Further, thermal shorts are eliminated as a result of removing fasteners from the floor and instead using friction stir or MIG welds.

The supporting sheet 16 and attachment guides provided by top caps 30 and bottom caps 32 eliminate the deformation and eventual failure or tipping of the transverse stringers 12, which is also a problem associated with prior art structures. The transverse bottom flanges 14 with bottom caps 32 also provide the ability to weld the assembly to the longitudinal side rail 22, such as at locations E and F, which completely seals the floor assembly 10. Welding eliminates the problem of galvanic corrosion between dissimilar metals and provides an airtight, thermally efficient coupling, in contrast to bolted or riveted connections between the floor supporting members and the outside rail as shown in the prior art. Further, by eliminating the use of steel cross members underneath the floor assembly 10 for mounting purposes by instead requiring that the thermally isolating transverse stringers 12 provide structural support, this present design has a lower center of gravity, reducing the likelihood of tipping.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other assemblies. It is to be expected that various equivalents, alternatives and modifications are possible within the scope of the appended claims.

What is claimed is:

1. A floor assembly for a trailer, the floor assembly being defined along a transverse direction and a longitudinal direction perpendicular to the transverse direction and comprising:

a plurality of stringers that extend in the transverse direction of the floor assembly and are spaced from one another in the longitudinal direction of the floor assembly, the plurality of stringers being made of a thermally insulative first material;

a bottom flange coupled to a lower portion of a respective stringer in the plurality of stringers, wherein opposite ends of the bottom flange extend in the transverse direction beyond opposite ends of the respective stringer;

a top flange coupled to an upper portion of a respective stringer in the plurality of stringers, the top flange being made of a second material that is different than the first material;

a plurality of floor panels, wherein each floor panel in the plurality of floor panels extends in the longitudinal direction, is supported by the top flange, is coupled to another floor panel along respective edges thereof that extend in the longitudinal direction, and has at least one rib that extends in the longitudinal direction and depends substantially perpendicularly from a bottom surface of the floor panel;

opposite side rails that extend in the longitudinal direction and are coupled to the respective opposite ends of and extend perpendicularly with respect to the bottom flange to respective upper edges located above the top flange that are configured to be connected to respective opposite side wall panels to form a container;

an extrusion extending in the transverse direction and projecting upwardly from an upper surface of the bottom flange, the extrusion having opposite ends that are directly welded to a respective one of the opposite side rails; and a lip extending in the longitudinal direction on each of the opposite side rails, wherein each lip extends under the bottom flange and is welded to a lower surface of the bottom flange at one of the respective opposite ends of the bottom flange, and wherein each lip extends above the extrusion and is welded to an upper surface of the extrusion at one of the respective opposite ends of the extrusion;

wherein each floor panel is made of the second material and each at least one rib is welded directly to a top surface of the top flange.

2. The floor assembly of claim 1, further comprising a plurality of bottom flanges that extend in the transverse direction, each bottom flange in the plurality of bottom flanges being coupled to the lower portion of a respective stringer in the plurality of stringers and being welded to a neighboring bottom flange along respective side edges thereof that extend in the transverse direction.

3. The floor assembly of claim 2, wherein opposite ends of each bottom flange extend in the transverse direction beyond opposite ends of the respective stringer, and wherein each lip extends under each bottom flange and is welded to a lower surface of each bottom flange at one of the respective opposite ends of each bottom flange.

4. The floor assembly of claim 2, further comprising a plurality of extrusions, each extrusion in the plurality of extrusions extending in the transverse direction beyond opposite ends of a respective stringer in the plurality of stringers and projecting upwardly from an upper surface of a respective bottom flange in the plurality of bottom flanges, each extrusion having opposite ends that are directly welded to a respective one of the opposite side rails.

5. The floor assembly of claim 1, further comprising a bottom cap associated with each respective stringer, the bottom cap extending in the transverse direction and comprising a lower channel for seating the lower portion of the respective stringer therein, wherein the bottom cap is located on the upper surface of the bottom flange.

6. The floor assembly of claim 5, further comprising a top cap associated with each respective stringer, the top cap extending in the transverse direction and comprising an upper channel for locating the upper portion of the respective stringer therein, wherein the top cap is located on a bottom surface of the top flange.

7. The floor assembly of claim 6, wherein the bottom cap and the top cap are provided as a guide for each respective stringer such that the respective stringer remains in place within the lower and upper channels and perpendicularly upright between the bottom and top flanges.

8. The floor assembly of claim 1, wherein the plurality of stringers, coupled between the bottom flange and the top flange, act as structural members and together with the bottom flange and the top flange support a given load, and wherein no additional transverse beams are provided beneath the bottom flange.

9. The floor assembly of claim 1, wherein each floor panel is friction stir welded to another floor panel along the respective edges thereof to form a floor surface.

10. A floor assembly for a trailer, the floor assembly being defined along a transverse direction and a longitudinal direction perpendicular to the transverse direction and comprising:

a plurality of stringers that extend in the transverse direction of the floor assembly and are spaced from one another in the longitudinal direction of the floor assembly, the plurality of stringers being made of a first material;

a bottom flange coupled to a lower portion of a stringer in the plurality of stringers;

a plurality of bottom caps, each bottom cap in the plurality of bottom caps being associated with a respective stringer in the plurality of stringers, each bottom cap extending in the transverse direction and comprising a lower channel for seating a lower portion of the respective stringer therein, wherein each bottom cap projects from an upper surface of the bottom flange, and wherein each bottom cap is adhered directly to the lower portion of the respective stringer;

a top flange coupled to an upper portion of a stringer in the plurality of stringers, the top flange being made of a second material that is different than the first material;

a plurality of top caps, each top cap in the plurality of top caps being associated with a respective stringer, each top cap extending in the transverse direction and comprising an upper channel for locating an upper portion of the respective stringer therein, wherein each top cap is one of integral with and directly coupled to a bottom surface of the top flange, and wherein each top cap is adhered directly to the upper portion of the respective stringer; and a plurality of floor panels, wherein each floor panel in the plurality of floor panels extends in the longitudinal direction, is supported by and directly welded to a top surface of the top flange, and is coupled to another floor panel along respective edges thereof that extend in the longitudinal direction to form a floor surface;

wherein each bottom cap and each top cap are provided as a guide for the respective stringer such that the respective stringer remains in place within the lower and upper channels and perpendicularly upright between the bottom and top flanges.

11. The floor assembly of claim 10, further comprising a plurality of bottom flanges that extend in the transverse direction, each bottom flange in the plurality of bottom flanges being coupled to the lower portion of a respective stringer in the plurality of stringers and being coupled to a neighboring bottom flange along respective side edges thereof that extend in the transverse direction.

12. The floor assembly of claim 11, wherein at least one side edge of each bottom flange is welded to a respective neighboring side edge of a respective neighboring bottom flange beneath a respective stringer in the plurality of stringers.

13. The floor assembly of claim 12, wherein each bottom cap in the plurality of bottom caps is formed where the at least one side edge of each bottom flange is welded to the respective neighboring side edge of the respective neighboring bottom flange.

14. The floor assembly of claim 13, further comprising:

opposite side rails that extend in the longitudinal direction and are coupled to opposite ends of and extend perpendicularly with respect to each bottom flange to respective upper edges located above the top flange that are configured to be connected to respective opposite side wall panels to form a container; and a plurality of extrusions, each extrusion in the plurality of extrusions extending in the transverse direction and projecting upwardly from an upper surface of a respective bottom flange, each extrusion having opposite ends that are directly welded to a respective one of the opposite side rails.

15. The floor assembly of claim 14, wherein each bottom flange comprises half of a first bottom cap adjacent a first side edge thereof, a respective extrusion, and half of a second bottom cap adjacent a second side edge thereof.

16. The floor assembly of claim 10, further comprising a plurality of ribs that extend in the longitudinal direction and depend substantially perpendicularly from a bottom surface of each floor panel, wherein a lower end of each rib in the plurality of ribs on each floor panel comprises a projection that is parallel to the top surface of the top flange and is welded thereto.

17. The floor assembly of claim 10, wherein the first material is a thermally insulative material.

18. The floor assembly of claim 17, wherein the first material is one of a thermoplastic and wood.

* * * * *